US006040515A

United States Patent [19]

Mukojima et al.

[11] Patent Number: 6,040,515

[45] Date of Patent: Mar. 21, 2000

[54] METHOD AND DEVICE FOR GENERATING A TONE

[75] Inventors: Masahiro Mukojima; Ryo Kamiya, both of Hamamatsu, Japan

[73] Assignee: Yamaha Corporation, Hamamatsu, Japan

[21] Appl. No.: 09/388,987

[22] Filed: Sep. 2, 1999

Related U.S. Application Data

[62] Division of application No. 08/770,357, Dec. 20, 1996, Pat. No. 5,973,251.

[30] Foreign Application Priority Data

Dec. 21, 1995 [JP] Japan ..... 7-349046

[51] Int. Cl.[7] ..... G10H 7/00

[52] U.S. Cl. ..... 84/603

[58] Field of Search ..... 84/603–606

[56] References Cited

U.S. PATENT DOCUMENTS

| | | | |
|---|---|---|---|
| 4,899,632 | 2/1990 | Okamura | 84/601 |
| 5,345,035 | 9/1994 | Yamada | 84/622 |
| 5,717,154 | 2/1998 | Gulick | 84/604 |
| 5,763,801 | 6/1998 | Gulick | 84/604 |

*Primary Examiner*—Jeffrey Donels
*Attorney, Agent, or Firm*—Graham & James LLP

[57] ABSTRACT

In a case where tone waveform sample data are to be arithmetically formed by software, there are installed, within a virtual device driver routine of an operating system, a MIDI processing routine for converting a received MIDI event into tone generator control data and a waveform forming processing routine for arithmetically forming tone waveform sample data for one frame. The MIDI processing routine is triggered by a software interrupt signal that is generated in response to a MIDI event produced from an application software program such as a sequencer software program, and the waveform forming processing routine is triggered by a hardware interrupt signal that is generated upon completion of tone reproduction for one frame.

3 Claims, 8 Drawing Sheets

METHOD AND DEVICE FOR GENERATING A TONE

RELATED APPLICATION

This application is a divisional application of application Ser. No. 08/770,357, filed on Dec. 20, 1996 U.S. Pat. No. 5,973,251.

BACKGROUND OF THE INVENTION

The present invention relates to a tone generating method for arithmetically forming a tone waveform by executing a tone generating program on an arithmetic processor, and a tone generating device based on the tone generating method.

Tone generating devices have been known today, typical examples of which comprise a MIDI (Musical Instrument Digital Interface), a performance input section for entering performance information via a keyboard or sequencer, a tone generator section for generating a tone waveform, and a central processing unit (CPU) for controlling the tone generator section in accordance with the entered performance information. The CPU executes various tone generator driver processing, such as channel assignment and parameter conversion, in accordance with the entered performance information, and supplies the assigned channel with the converted parameters along with a tone-generation start (note-on) instruction. The tone generator section forms a tone waveform on the basis of the supplied parameters and is implemented by hardware such as electronic circuitry. Therefore, the conventional tone generating devices just operate as dedicated devices for tone generation, and it was always necessary to employ such a dedicated device when artificial tones were to be generated.

Recently, a tone generating method has been proposed, in which tone generator processing based on computer programs (software tone generator) is employed in place of the traditional hardware tone generator and performance processing and tone generator processing are both executed by the CPU. Similarly to the above-mentioned tone generator driver processing, the performance processing creates tone control information on the basis of received MIDI information or other performance information. The tone generator processing, on the other hand, forms tone waveform sample data on the basis of the control information created by the performance processing. With this tone generating method, tones can be generated, without any dedicated tone generating device, by just providing a CPU, software program and digital-to-analog (D/A) converter.

In order to generate tones, it is necessary to supply waveform sample data to the D/A converter every sampling cycle, i.e., every conversion timing of the D/A converter. According to the above-mentioned conventional tone generating method, the CPU normally executes the performance processing, such as detection of depressed keys. But, the CPU interrupts the performance processing, every sampling cycle, to execute the tone generator processing in order to arithmetically form one waveform sample data for a plurality of tone generating channels and then returns to the performance processing after the sample data formation.

However, in the above-mentioned conventional tone generating method, the CPU needs to transfer, from a memory into a predetermined register, various data used in the preceding calculation for each of the channels before actually executing the waveform forming calculation for the channel every sampling cycle; after completion of the calculation, the CPU needs to save the contents of the register into the memory, for next execution of the calculation. Namely, because tone waveform sample data is arithmetically formed, for each of the channels, sample by sample in the conventional tone generating method, much time would be spent in preparing operations rather than the tone formation itself, which would result in poor calculating efficiency and response and would considerably delay the tone generating processing. As a result, sufficient time can not be allocated to the waveform forming calculation.

Application programs, such as MIDI sequencer software or game software, for supplying such a software tone generator with MIDI event information or other performance information are designed to operate under an ordinary operating system (OS). When the software tone generator is to be driven by MIDI event information created by the MIDI sequencer software, the sequencer software itself can not be activated unless the OS is run; however, in such a case, it is necessary to operate the software simultaneously with the OS in a stable manner. Thus, it is difficult to operate, in real time, the above-mentioned software tone generator under the ordinary OS.

For example, with an OS based on a non-complete (non-preemptive) multitask scheme, unless a specific task being executed returns control to the OS, any other task is not executed. Thus, the software tone generator can sometimes not be executed at predetermined time intervals, and accordingly tone waveform sample data may not be stably output every sampling cycle.

Further, performance information (MIDI event information) is produced by a player'Is performance operation or by reproduction of an event via a sequencer, and the produced performance information is processed by the above-mentioned performance processing. Namely, each time performance information is produced, the CPU must execute the performance processing in addition to the normal tone generator processing; thus, due to non-periodically produced performance information, the amount of calculation to be performed would temporarily increase to a substantial degree. However, because the tone generator processing is periodically executed with priority over the performance processing irrespective of presence/absence of performance information, the performance processing could be substantially delayed in some cases.

One approach to avoid such time delays of the performance processing may be to give higher priority to the performance processing rather than the tone generator processing. But, this approach would result in unstable operation of the tone generator processing, such as temporary decrease in the number of generated tones or unwanted temporary break in a formed tone waveform. Particularly, such unstable operation of the tone generator processing would become a significant problem in a real-time performance.

In addition, the conventional software tone generator would require various setting operations before being actually used, because the software tone generator can not be driven by just running an application software program using the conventional hardware generator, i.e., without making any particular change to the application.

SUMMARY OF THE INVENTION

It is therefore an object of the present invention to provide a tone generating method and device which are capable of executing waveform forming calculation in an efficient and stable manner.

It is another object of the present invention to permit stable tone generator processing even when an amount of processing temporarily increases.

It is still another object of the present invention to provide a software tone generator which can run an application software program using a conventional hardware generator without making any change to the application.

In order to accomplish the above-mentioned object, the present invention provides a tone generating method for execution with an arithmetic processing device based on a predetermined operating system, which method comprises: a first step of, in response to a first interrupt signal generated when performance information is output from an application program, generating tone control information corresponding to the performance information; a second step of, in response to a second interrupt signal generated upon detection of a decrease in a number of tone waveform sample data stored in a buffer memory, forming a plurality of tone waveform sample data collectively and storing the formed tone waveform sample data into the buffer memory; and a third step of reading out one of the tone waveform sample data from the buffer memory to sequentially send the read-out tone waveform sample data to a digital-to-analog converter, every sampling cycle.

The above-mentioned first and second steps are effected as virtual device drivers of the predetermined operating system. The second interrupt signal is generated when it is detected that a predetermined number of the waveform tone sample data have been sent to the digital-to-analog converter.

The present invention also provides a tone generating device which comprises: a storage device for having stored therein a predetermined operating system and an application program; a buffer memory for storing therein arithmetically formed tone waveform sample data; an output circuit for reading out one of the tone waveform sample data from the buffer memory to sequentially output the read-out tone waveform sample data, every sampling cycle; a first interrupt generating section for generating a first interrupt signal when performance information is output from the application program; a second interrupt generating section for generating a second interrupt signal upon detection of a decrease in a number of the tone waveform sample data stored in the buffer memory; a control information generating section for, in response to the first interrupt signal, generating tone control information corresponding to the performance information output from the application program; and a tone waveform forming section for, in response to the second interrupt signal, forming a plurality of tone waveform sample data collectively and storing the formed tone waveform sample data into the buffer memory.

The above-mentioned control information generating section and tone waveform forming section are contained in a virtual device driver of the predetermined operating system.

BRIEF DESCRIPTION OF THE DRAWINGS

For better understanding of the above and other features of the present invention, the preferred embodiments of the invention will be described in detail below with reference to the accompanying, in which.

DETAILED DESCRIPTION OF THE PREFERRED EMBODIMENTS

Figure 1:
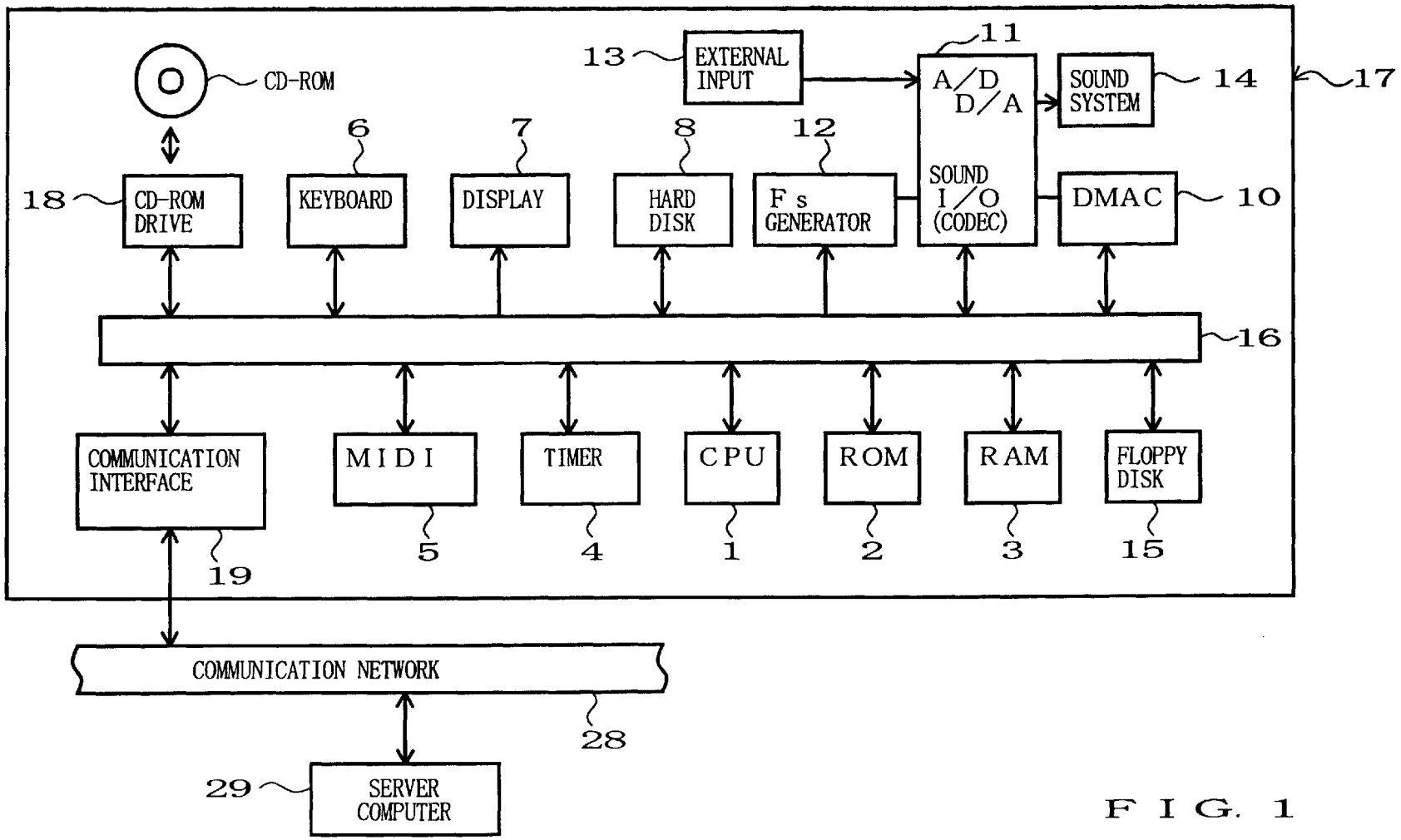
FIG. 1 is a block diagram illustrating an exemplary structure of a tone generating device used to implement a tone generating method of the present invention.

FIG. 1 is a block diagram illustrating an embodiment of a tone generating device 17 used to implement a tone generating method of the present invention.

The tone generating device 17 shown in FIG. 1 comprises: a central processing unit (CPU) 1, such as a microprocessor, which executes application programs and various arithmetic operations to arithmetically form tone waveform sample data, etc.; a read-only memory (ROM) 2 having stored therein preset tone color data and the like; a random access memory (RAM) 3 having a working memory area for the CPU 1, and storage areas such as a tone color data area, channel register area and output buffer areas; a timer 4 for indicating current time and designating timer interrupt timing to the CPU 1; a MIDI interface 5 via which MIDI event information is input to the device 17 and MIDI event data created in response to the MIDI event information is output from the device 17; and a keyboard 6, similar to that of an ordinary personal computer, having keys of English and Japanese alphabets, numerals, symbols, etc. As well known in the art, "MIDI" is an acronym of Musical Instrument Digital Interface.

The tone generating device 17 further comprises: a display (monitor) 7 via which a user is allowed to dialog with the device 17; a hard disk (HDD) 8 which has installed therein various application programs, such as a sequencer software program for generating tones and game software programs, and also has prestored therein tone waveform data to be used to arithmetically form tone waveform sample data; and a direct memory access controller (DMAC) 10 which, without any intervention of the CPU 1, permits a direct transfer of tone waveform sample data from one of the areas (DMA buffer) of RAM 3 designated by the CPU 1 to a digital-to-analog (D/A) converter (DAC) of a sound input/output circuit (CODEC) 11 at a predetermined sampling frequency (for example, 48 kHz).

The sound input/output circuit 11 called a CODEC contains the D/A converter, an analog-to-digital converter A/D, an input FIFO (first-in First-out) buffer connected to the A/D converter, and an output FIFO buffer connected to the D/A converter. In the sound input/output circuit (CODEC) 11, the input FIFO buffer receives audio input signals, via an external audio signal input circuit 13, converted by the A/D converter in response to sampling clock pulses of frequency Fs fed from a sampling clock generator 12. Also, the input/output circuit 11 reads out waveform sample data written from the DMAC 10 into the output FIFO buffer in response to the sampling clock pulses, and supplies the read-out waveform sample data to the D/A converter, sample by sample (one sample at a time). When any data is present in the input FIFO buffer and there is any empty space in the output FIFO buffer, the sound input/output circuit 11 operates to output a data-process request signal to the DMAC 10.

The sampling clock generator 12 supplies the sampling clock pulses of frequency Fs to the sound input/output circuit 11 as mentioned above. The output of the external audio signal input circuit 13 is connected to the A/D converter of the sound input/output circuit 11. A sound system 14 is connected to the output of the D/A converter of the input/output circuit 11 and audibly reproduces or sounds the analog tone signals supplied from the D/A converter every sampling cycle. Further, reference numeral 15 is a floppy disk device for driving a floppy disk, and 16 is a bus for data transfer between the above-mentioned components of the device.

In the hard disk 8, there may be stored various data such as automatic performance data and chord progression data, as well as an operating program for practicing the present invention. By prestoring the operating program in the hard disk 8 rather than in the ROM 2 and also loading the operating program into the RAM 3, the CPU 1 can operate in exactly the same way as where the operating program is stored in the ROM 2. This greatly facilitates version-up of the operation program, addition of an operating program, etc. A CD-ROM (compact disk) may be used as a removably-attachable external recording medium for recording various data such as automatic performance data, chord progression data and tone waveform data and optional operating or application programs. Such an operating program and data stored in the CD-ROM can be read out by a CD-ROM drive 18 to be transferred for storage into the hard disk 8. This facilitates installation and version-up of the operating program. The removably-attachable external recording medium may be other than the CD-ROM, such as a floppy disk and magneto optical disk (MO).

A communication interface 19 may be connected to a bus 16 so that the device 17 can be connected via the interface 19 to a communication network 28 such as a LAN (local area network), internet and telephone line network and can also be connected to an appropriate sever computer 29 via the communication network 28. Thus, in a case where the operating program and various data are not contained in the hard disk 8, these operating program and data can be received from the server computer 29 and downloaded into the hard disk 8. In such a case, the tone generating device 17, working as a "client", sends a command requesting the server computer 29 to download the operating program and various data by way of the communication interface 19 and communication network 28. In response to the command, the server computer 29 delivers the requested operating program and data to the tone generating device 17 via the communication network 28. The tone generating device 17 completes the necessary downloading by receiving the operating program and data via the communication network 19 and storing these into the hard disk 8.

It should also be understood here that the tone generating device 17 may be implemented by installing the operating program and various data corresponding to the present invention in a commercially available personal computer. In such a case, the operating program and various data corresponding to the present invention may be provided to users in a recorded form on a recording medium, such as a CD-ROM or floppy disk, which is readable by the personal computer. Where the personal computer is connected to a communication network such as a LAN, the operating program and various data may be supplied to the personal computer via the communication network similarly to the above-mentioned.

In some cases, one or more external drive for driving a recording medium, other than the CD-ROM drive 18, may be connected with the tone generating device 17, such as a MO (Magneto-optical disk) drive.

The tone generating device 17 arranged in the above-mentioned manner can use a general-purpose computer, such as a personal computer or work station, to implement the tone generating method of the present invention.

Figure 2:
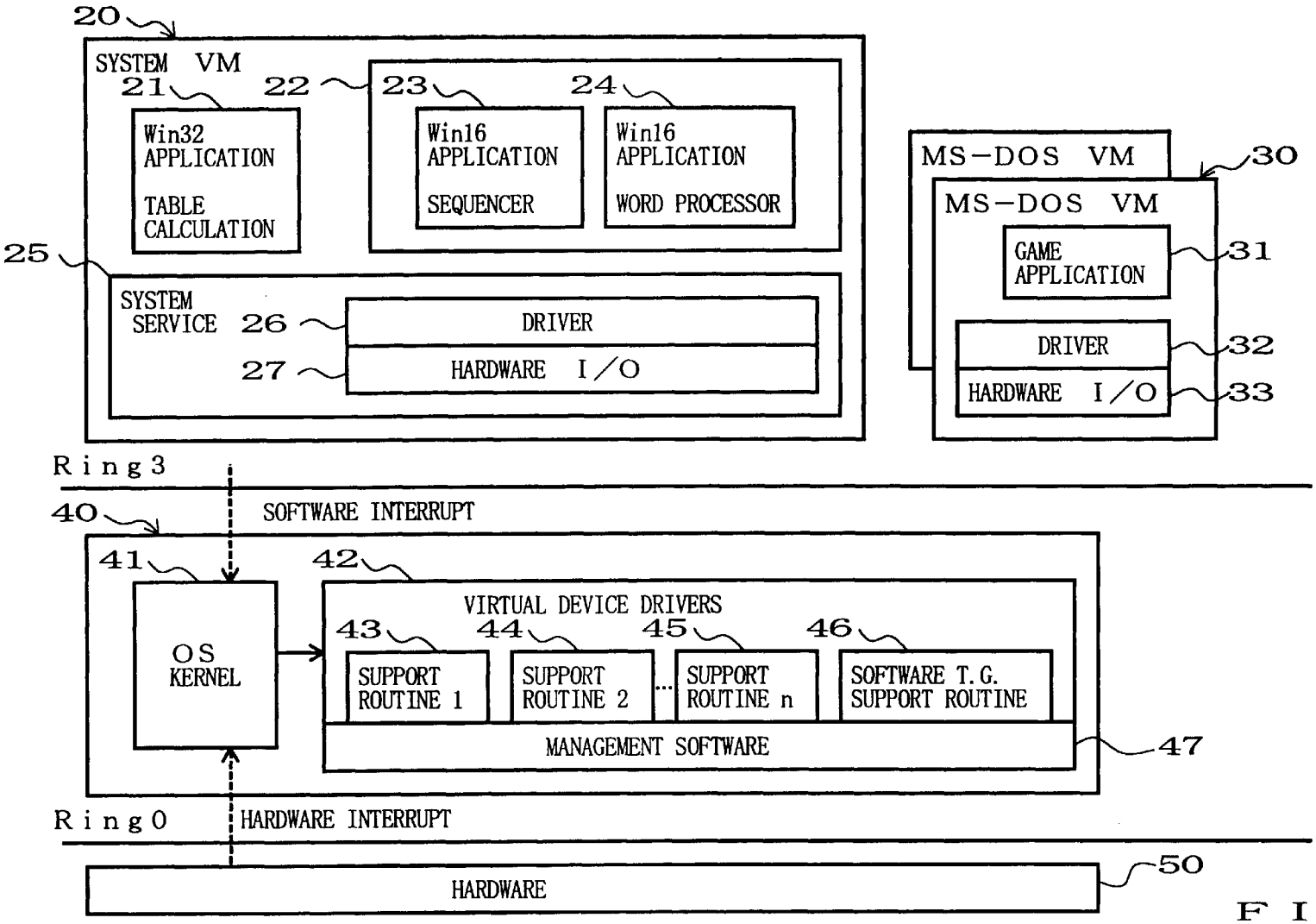
FIG. 2 is a diagram illustrating a software module configuration for implementing the tone generating device shown in FIG. 1.

FIG. 2 is a diagram illustrating an example of a software module configuration for implementing the tone generating device 17 shown in FIG. 1. The illustrated example of FIG. 2 is described below on the assumption that "Windows95" ("Windows" is a registered trademark of Microsoft Corporation, U.S.A.) is used as the operating system. In this operating system, each application program is run under the environment of virtual machines (VMs) corresponding to the operating system. The Windows virtual machines (Windows VMs) used here refer to contexts for running an application program, and the Windows contexts include a memory map addressable by the application, contents of hardware registers, and Windows resources allocated to the application. The illustrated example includes two Windows VMs, system VM 20 and MS-DOS VM 30.

In the illustrated example of FIG. 2, the system VM 20 and MS-DOS VM 30 are components of Ring 3. As shown, application programs 21, 23 and 24 are provided in the system VM 20, and the application program 21 is a program for Windows95 operable with 32-bit codes (Win 32 application), which is assumed here to have installed therein a table calculating program. In an address space 22, there are provided the sequencer program 23 that is an application program for Windows and word processor software 24. In the system VM 20, there is also provided a system service component 25 for Windows, which contains various driver software 26 and hardware I/O registers 27.

Further, in the MS-DOS VM 30, there are installed application programs for MS-DOS such as a game application program 31 for MS-DOS, and there are prepared MS-DOS environments such as driver software 32 and hardware I/O 33 for MS-DOS. The game application program 31 is designed to generate tones, such as effect sounds, via the MIDI.

In Ring 0, there is provided a basic system section 40 for Windows95 including a file management system which includes an OS kernel section 41, virtual device drivers 42 and management software 47.

The virtual device drivers 42 include a plurality of virtual device driver routines, such as support routine 1—support routine n denoted at 43 to 45, and a software tone-generator (T.G.) support routine 46. These virtual device driver routines are program modules in a 32-bit protect mode to supply various services corresponding to various software and hardware interrupt signals and operates in a privileged level Ring0 of a processor.

In response to each of various software interrupt signals from various virtual machines (VMs) and various hardware interrupt signals from various hardware components, the kernel section 41 runs any of the virtual device driver routines corresponding to the interrupt signal.

Further, in FIG. 2, reference numeral 50 represents various hardware components such as the above-mentioned sound input/output circuit (CODEC) 11 and MIDI interface 5. Each of interrupt signals from these hardware components is received by the kernel section 41, so that corresponding processing is executed by any of the support routines 43 to 45 and software tone-generator support routine 46 corresponding to the received interrupt signal.

The virtual device drivers (V×D) are normally provided to allow a plurality of virtual computers (VM) to share hardware resources incorporated in a personal computer, and they perform management as to which (one or more) of the virtual machines should be allowed to use the hardware resources. To this end, the virtual device drivers are provided, between the virtual machines and the hardware components, so as to detect when one of the device drivers in any of the virtual machines is accessing an address of the corresponding hardware components, to thereby act as an intermediary in the accessing to the hardware component. The virtual device drivers V×D also deliver an output from any of the hardware components to the device driver in the corresponding virtual machine.

As mentioned earlier, the virtual device drivers 42 include the software tone-generator support routine 46, which contains a MIDI processing routine and a waveform formation processing routine as will be later described. This software tone-generator support routine 46 is designed to simulate tone generator hardware that does not exist in reality, rather than acting as the above-mentioned accessing intermediary. By so doing, there can be obtained a situation where the virtual machine can not recognize whether or not the personal computer is actually equipped with a hardware tone generator. That is, each of the virtual machines is permitted to use the software tone generator exactly in the same way as where a hardware tone generator is operated.

Figure 3:
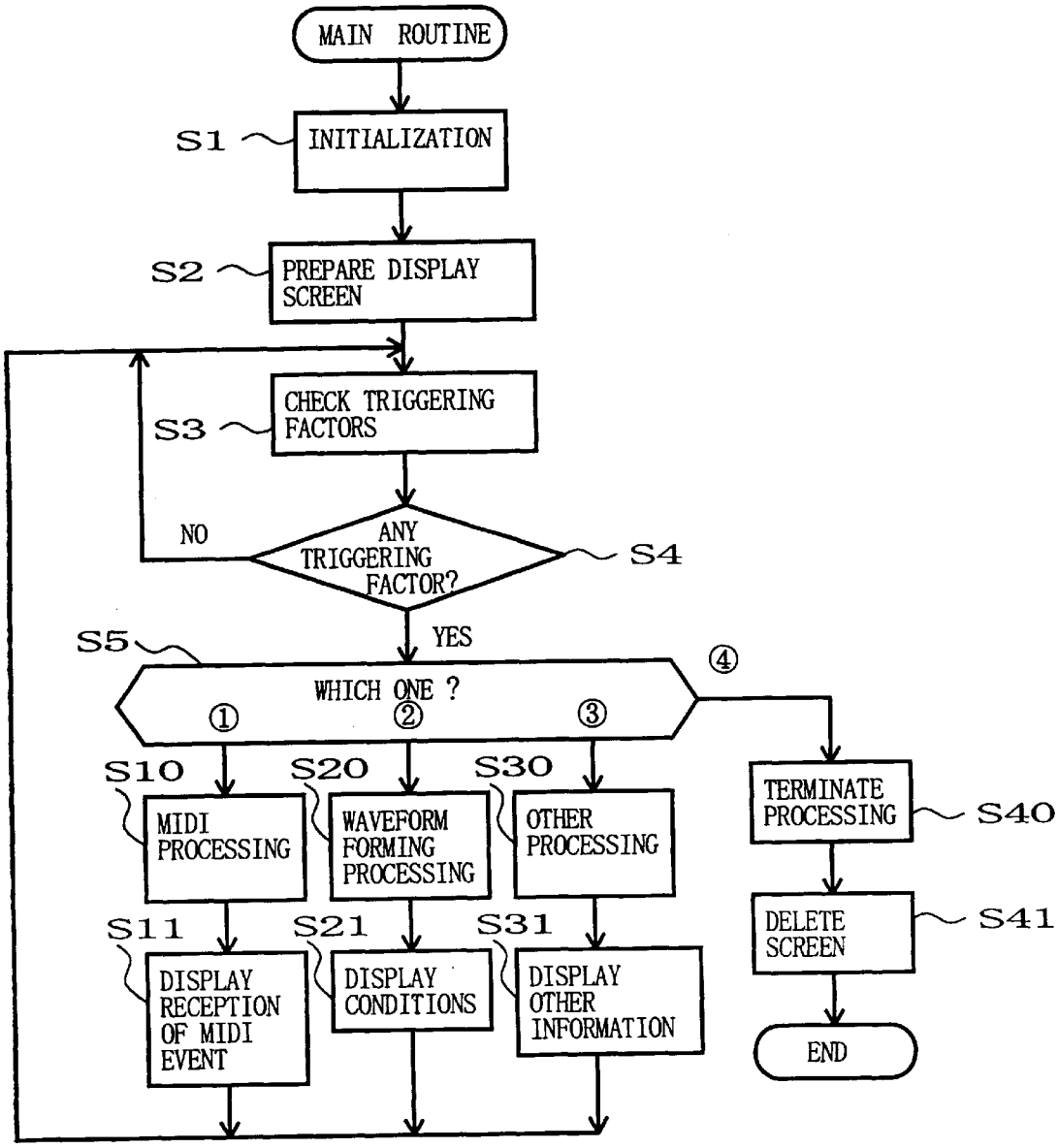
FIG. 3 is a flowchart illustrating various processing executed in a software tone generator using the tone generating method of the present invention.

FIG. 3 is a flowchart illustrating a main routine executed in the software tone generator using the tone generating method of the present invention.

Upon start-up of the software tone generator, various initialization processing is executed at step S1, such as for securing various buffer areas in the RAM 3, loading the software tone-generator support routine 46 (including the MIDI processing routine and waveform formation processing routine) into the virtual device driver section 42, setting data transfer by the direct memory access controller DMAC 10, and setting an interrupt from hardware components such as the sound input/output circuit (CODEC) 11. At next step S2, a display screen is prepared for the software tone generator. Then, the main routine proceeds to step S3 to check to see whether any of predetermined triggering factors has occurred at step S3 and determines presence or absence of the triggering factor at step S4. If any of the triggering factors has occurred, the main routine goes to step S5; otherwise the main routine loops back to step S3 to repeat the operations of steps S3 and S4.

At step S5, a determination is made as to which of the triggering factors has occurred, and at the following steps, different operations are executed depending on the identified triggering factor. According to the embodiment, the predetermined triggering factors to be identified are:

(1) Output of a MIDI event from the sequencer software or the like;

(2) Completion of reproduction (i.e., output to the D/A converter) of waveform sample data for one frame;

(3) A request made via an operation panel input, command input or the like; and (4) A request for termination made via a termination command input or the like.

As will be later described, the output of a MIDI event from the sequencer software or the like at item (1) above (triggering factor 1) is informed as a software interrupt signal, and the completion of reproduction of waveform sample data for one frame at item (2) (triggering factor 2) is informed as a hardware interrupt signal from the sound input/output circuit 11 or DMAC 10. The requests at items (3) and (4) (triggering factors 3 and 4), which are entered by a user via the keyboard 6, operation panel or window screen of the display 7, are subjected to service by a program in the Windows system service component 25. Operations corresponding to triggering factor 1 and triggering factor 2 are executed with priority over those corresponding to triggering factor 3 and triggering factor 4.

When output of a MIDI event from the sequencer software or the like (triggering factor 1) has occurred as determined at step S5, MIDI processing (MIDI interpreter processing) is executed at step S10 as a virtual device driver. In this MIDI processing, a note-on, note-off, program change, control change, system-exclusive or other operation is executed in response to the MIDI event output from a tone generating application program such as the sequencer or game software.

If the generated MIDI event is a note-on event, generation of a new tone is assigned to one of tone generating channels of the waveform forming processing operating as a tone generator, and tone control data and note-on data to be used in the assigned tone generating channel are prepared. That is, note number NN and velocity data VEL of the output MIDI event are received, and the note number NN is assigned to one of the tone generating channels (CH), and tone generating data obtained by processing tone color data, corresponding to the MIDI channel having received the note-on event, in accordance with values of the note number NN and velocity data VEL are set into a channel register for the assigned tone generating channel.

If the generated MIDI event is a note-off event, one of the tone generating channels is identified which is sounding note number NN of the note-off event, and a note-on flag for the identified channel is reset.

After completion of the MIDI processing of step S10, the main routine proceeds to step S11, where a visual indication is made on the display 7 that the MIDI event has been received. Then, the main routine loops back to step S3 to wait for next occurrence of any of the triggering factors.

If the triggering factor identified at step S5 is the completion of reproduction of waveform sample data for one frame (triggering factor 2), waveform forming processing is executed at step S20 as a virtual device driver, as with the MIDI processing. This waveform forming processing is designed to simulate the function of a hardware tone generator and arithmetically form tone waveform sample data together or collectively for a single frame period on the basis of tone control information generated by the MIDI processing. The thus-formed tone waveform sample data are temporarily stored into an output buffer.

Upon start-up of the waveform forming processing of step S20, various preparations are made to arithmetically form first tone waveform sample data for one of the tone generating channels (CH) given a first place in the calculating order. Such preparations (i.e., calculating preparations) involve operations to prepare various data of a last readout address, envelope waveform (hereinafter abbreviated as "EG"), state (state of attack, release or the like) of the EG, value of a low-frequency oscillator (hereinafter abbreviated as "LFO") signal and the like so that these data can be readily supplied for use in the tone waveform sample data calculation, as well as operations to load the various data into an internal register of the CPU 1. Then, waveform calculation is performed for the LFO, filter envelope waveform (hereinafter abbreviated as "FEG") and tone volume envelope waveform (hereinafter abbreviated as "AEG"), so as to form sample data of the LFO waveform, FEG waveform and AEG waveform that are necessary for arithmetic operations for a single frame period. The LFO waveform is added to an "F" number, FEG waveform and AEG waveform so as to modulate the respective data.

Following this, the F number is repetitively added to the last address value so as to generate a read address of every waveform sample data within the single frame period. Waveform sample data are read out from waveform storing locations of the tone color data storage area on the basis of the integral portions of the generated read addresses, and interpolation is performed between the read-out waveform sample data on the basis of the fractional portions of the generated read addresses. If the single frame period corresponds to a time for 64 samples, then 64 sample data are processed collectively in each unit time. In the processing for the plurality of sample data corresponding to the single frame period, the sample data readout based on the read addresses and the subsequent interpolation is executed as one unit operation and this unit operation is repetitively performed automatically, so that the read addresses need to be read into the CPU register only once, which will significantly increase processing speed.

Then, a tone color filter process is performed in order to effect tone color control of the interpolated sample data for the single frame period on the basis of the FEG waveform, and an amplitude control process is further performed on the filtered sample data on the basis of the AEG and tone volume data. After this, an accumulative writing process is performed, where these amplitude-controlled tone waveform sample data for the frame period are added to values already stored at respective sample locations (i.e., accumulated values of the corresponding sample data of one or more other tone generating channels) in the output buffer. In this embodiment, the amplitude control process and the accumulative writing process are executed in succession, so that the number of times the sample data need to be stored into the CPU register is substantially reduced and the processing speed is also significantly increased.

The above-mentioned processing, from the calculating preparations to the accumulative writing process, is then performed sequentially for the other tone generating channels that are given second and subsequent places in the calculating order.

When the tone waveform forming processing is completed, the output buffer has stored therein accumulated values of tone waveform sample data formed in all the assigned channels for one frame period (e.g., 64 sample data).

If the triggering factor identified at step S5 is the request via an operation panel input, command input or the like (triggering factor 3), the main routine goes to "Other Processing" of step S30, where various operations are executed depending on the request. For example, in response to a request made by the user or human operator via the operation panel or command input, various operations are executed to set a specific number of the tone generating channels, a sampling frequency and a capacity of the output buffer (this capacity corresponds to one frame period) to be used in the software tone generator. These settings and other information are visually indicated on the display screen at step S31, and then the main routine S3 loops back to step S3.

If the triggering factor identified at step S5 is the request for termination made via a termination command input or the like (triggering factor 4), the main routine goes to step S40 to terminate the processing, then deletes the visually displayed information about the software tone generator at step S41, and loops back to step S3.

Figure 4:
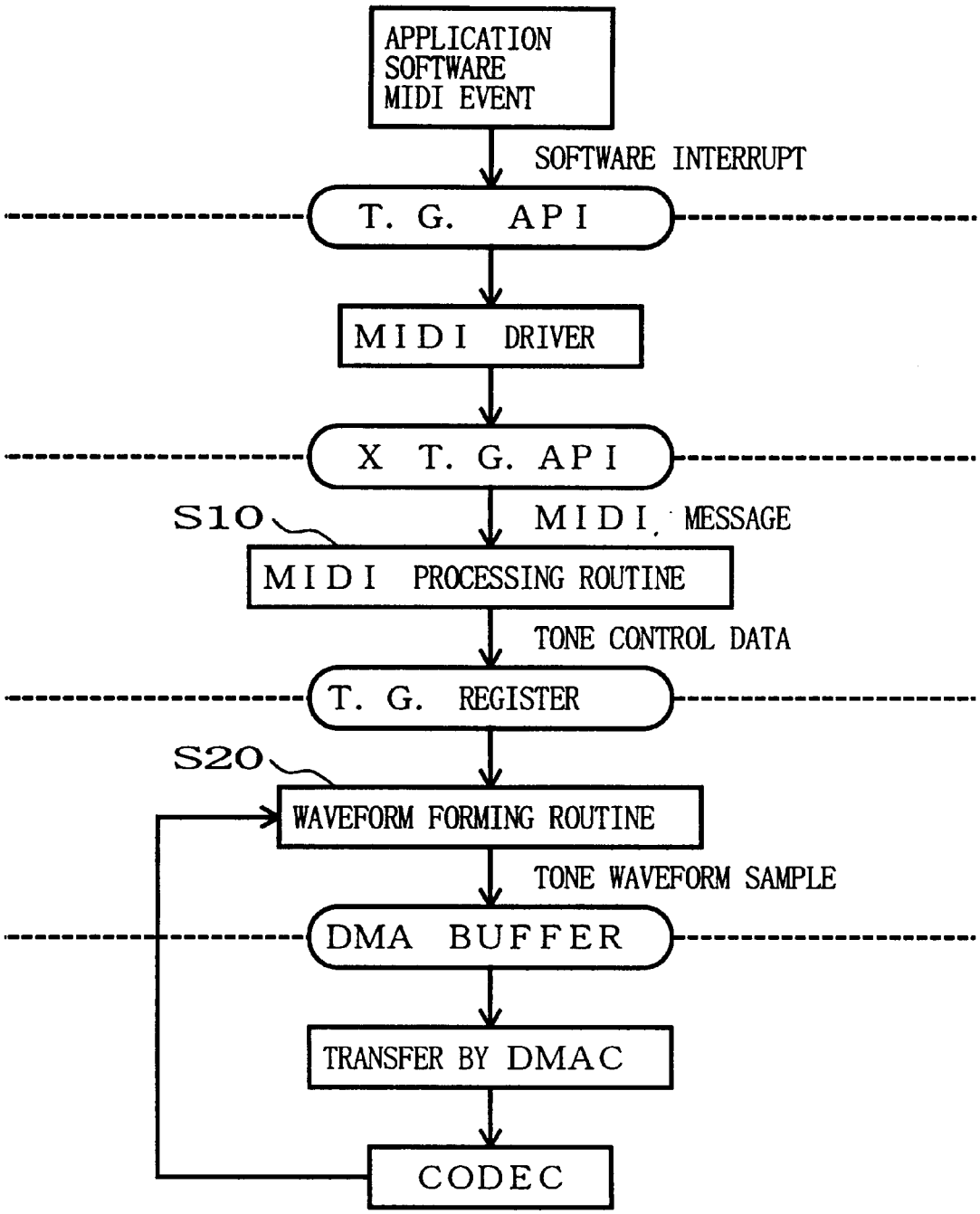
FIG. 4 is a chart illustrating an exemplary processing flow of the present invention.

FIG. 4 is a chart illustrating a flow of various signal data when the above-mentioned software tone generator is used to generate tones. Assume here that the tone generating software is the sequencer software 23 of FIG. 2 and a real-time performance is executed by use of the sequencer software. The sequencer software 23 is designed to receive performance information from the keyboard 6 or MIDI interface 5 and outputs corresponding MIDI event data in response to the received performance information.

First, the sequencer software 23 sends MIDI event data, corresponding to a tone to be generated, to a MIDI driver in the driver software group 26. This is done by calling a tone generator API (Application Programming Interface) of the virtual machine in question and generating a software interrupt signal. The MIDI driver transfers the MIDI message to the virtual device driver by way of the tone generator API, so that the MIDI processing routine (step S10) loaded as the virtual device driver is activated to generate tone control data corresponding to the MIDI message and set the generated data into the tone generator register for the tone generating channel in question. When a hardware interrupt signal is generated from the CODEC 11 upon completion of tone reproduction for one frame, the waveform forming routine (step S20) is activated to arithmetically form waveform sample data for one frame as earlier noted and the thus-formed tone waveform sample data are stored into the output buffer. The waveform sample data for one frame thus stored in the output buffer are then transferred to a DMA buffer. Then, under the control of the DMAC 10, the waveform sample data are read out from the DMA buffer, one sample per sampling cycle, and supplied to the D/A converter. Analog signals output from the D/A converter are audibly reproduced by means of the sound system 14.

The following paragraphs describe an example where the game software 31 in the MS-DOS VM 30 is a program having a function to generate tones by use of a MIDI-conforming tone generator. First, the game software 31 sends MIDI event data, corresponding to a tone to be generated, to the MIDI driver 32 within the MS-DOS VM 30, and the MIDI driver 32 writes the MIDI event data into the hardware register 33. Because a trap is set for direct access from any of the programs in Ring 3 to the hardware register 33, a software interrupt signal is generated upon detection of the write access to the hardware register 33, so that control shifts to Ring 0 to activate one of the virtual device drivers corresponding to the cause of the trap.

In a case where the personal computer used is equipped with a normal hardware tone generator, a virtual device driver corresponding to the hardware tone generator is installed and this virtual device driver for the hardware tone generator is activated. Because the hardware tone generator is activated via the virtual device driver, it can be shared among a plurality of virtual machines.

On the other hand, in a case where the personal computer used is not equipped with a hardware tone generator, the software tone generator support routine 46, one of the virtual device drivers, is activated to send the MIDI event data to the MIDI processing routine (step S10). After this, the tone generating processing is carried out in the above-mentioned manner. Thus, as viewed from the application program, the tone generating processing is executed by the software tone generator, exactly in the same manner as where the personal computer used is equipped with the hardware tone generator, without requiring any changes to the program and the like.

Now, with reference to FIGS. 5 and 6, a description will be made about an exemplary manner in which the tone waveform sample data arithmetically formed by the waveform forming section of step S20 are output from the D/A converter for audible reproduction.

Figure 5:
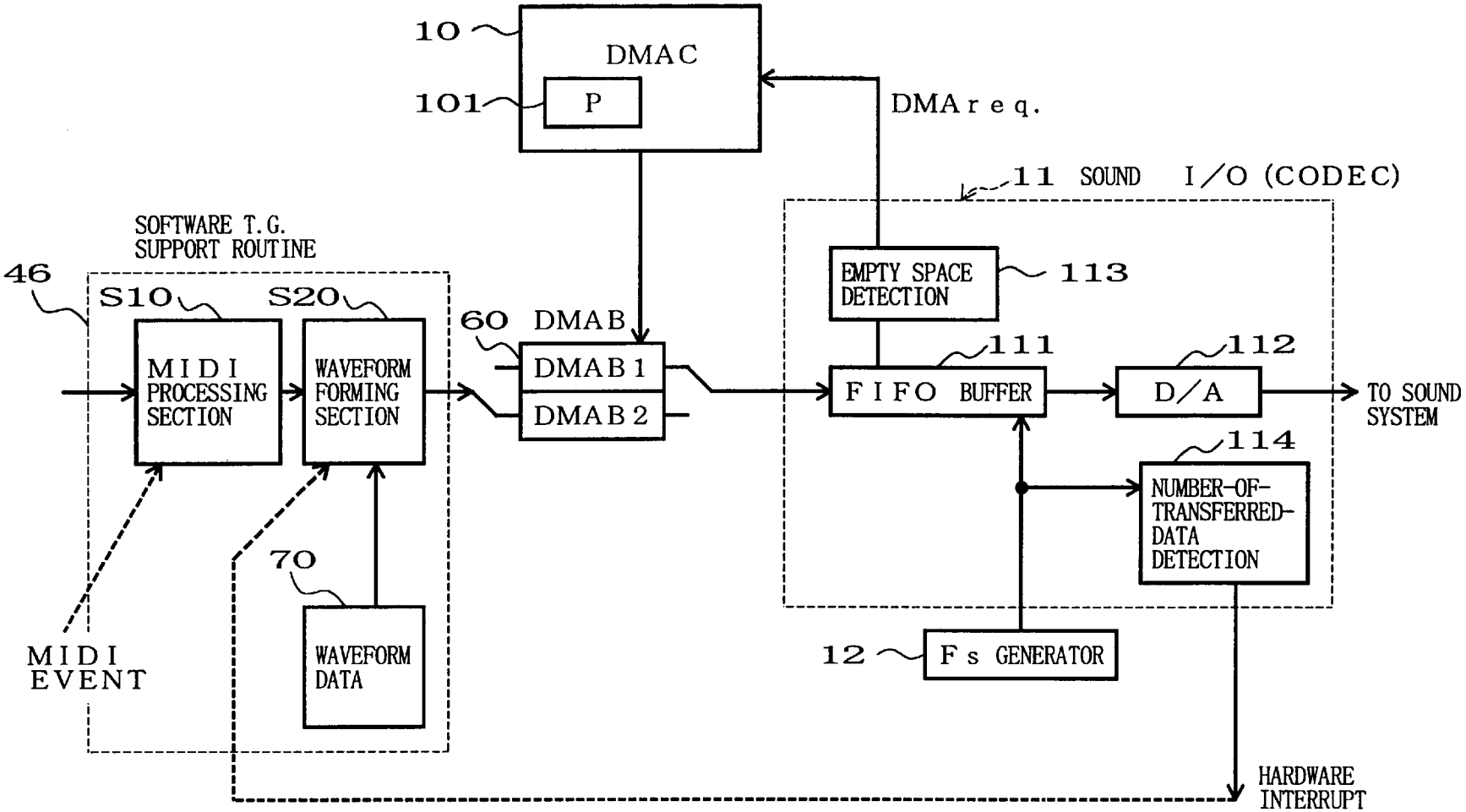
FIG. 5 is a chart illustrating an exemplary flow of arithmetically formed tone waveform data.

As shown in FIG. 5, in the above-mentioned direct memory access controller (DMAC) 10 is provided a pointer register 101 that designates a data read address p in the DMA buffer 60. In the sound input/output circuit (CODEC) 11, there are provided an output FIFO buffer 111 for storing therein the tone waveform sample data read out from the DMA buffer 60, D/A converter 112, an empty space detecting section 113 for detecting whether there is any empty space in the output FIFO buffer 111, and a number-of-transferred-data detecting section 114 for detecting when the number of the waveform sample data transferred from the FIFO buffer 111 to the D/A converter 112 has reached a predetermined value and outputting a hardware interrupt signal to the CPU 1. Although specifically not shown, the DMAC 10 further includes an input FIFO to which audio signals from the external audio input circuit 13, and an A/D converter for converting output signals from the input FIFO.

The sampling clock generator 12 generates sampling clock pulses of frequency Fs which are supplied to the FIFO buffer 111 and number-of-transferred-data detecting section 114. The DMA buffer (DMAB) 60, which is provided for storing therein the tone waveform sample data arithmetically formed by the waveform forming processing of step S20, comprises first and second buffer areas DMAB1 and DMAB2. Each of the buffer areas DMAB1 and DMAB2 has a capacity for storing therein a specific number of the tone waveform sample data corresponding to one frame period, so that when the tone waveform sample data are being read out from one of the buffer areas (e.g., DMAB1), the tone waveform sample data arithmetically formed at step S20 are stored into the other buffer area (e.g., DMAB2). Note that the number of the DMA buffer areas may be three or more rather than just two.

The software tone generator support routine 46, provided as one virtual device driver, contains the MIDI processing section (step S10) and waveform forming section (step S20) as described earlier, and the waveform forming calculation is executed by the waveform forming section using waveform sample data stored in a waveform data memory (waveform memory) 70.

As mentioned earlier, once a MIDI event occurs from an application program that executes performance processing, a software interrupt signal is generated, in response to which the MIDI processing section (step S10) in the software tone generator support routine 46 is activated and tone control parameters corresponding to the MIDI event are stored into the tone generator register. On the other hand, by being activated by a hardware interrupt signal from the CODEC 11, the waveform forming section (step S20) arithmetically forms a predetermined number of (e.g., 64) waveform sample data for one frame period in a plurality of tone generating channels (the maximum is 32 channels) and accumulates these data to generate waveform sample data for one frame period in the output buffer. Upon completion of the waveform forming calculation, the waveform sample data generated in the output buffer are transferred to one of the DMA buffer areas (DMAB2 in the example of FIG. 5).

The tone waveform data are transferred from the DMAB 60 to the FIFO buffer 111 of the sound input/output circuit (CODEC) 11 for temporary storage therein. In response to each of the sampling clock pulses generated at a frequency of 48 kHz, one of the tone waveform sample data is read out from the FIFO buffer 111 and transferred to the D/A converter 112. The D/A converter 112 converts the delivered tone waveform sample data into an analog voltage signal. The analog voltage signal is sent to the sound system 14, where it is passed through a low-pass filter, amplified by an amplifier and audibly reproduced or sounded through a speaker.

The sampling clock pulses generated by the sampling clock generator 12 are also fed to the number-of-transferred-data detecting section 114, by which the detecting section 114 counts the number of the waveform sample data transferred from the FIFO buffer 111 to the D/A converter 112. Once it is detected that the number of the waveform sample data transferred from the FIFO buffer 111 to the D/A converter 112 has reached a value corresponding to one frame period, the number-of-transferred-data detecting section 114 issues a hardware interrupt signal to the CPU 1. As previously mentioned, this hardware interrupt signal is received by the kernel section 41 of Ring 0 and thus the waveform forming section (step S20) is activated in the software tone-generator support routine 46.

Once the empty space detecting section 113, connected with the FIFO buffer 111, detects that an empty space available for data storage has been produced in the FIFO buffer, the section 113 outputs DMA request signal DMAreq to the DMAC 10.

Figure 6A:
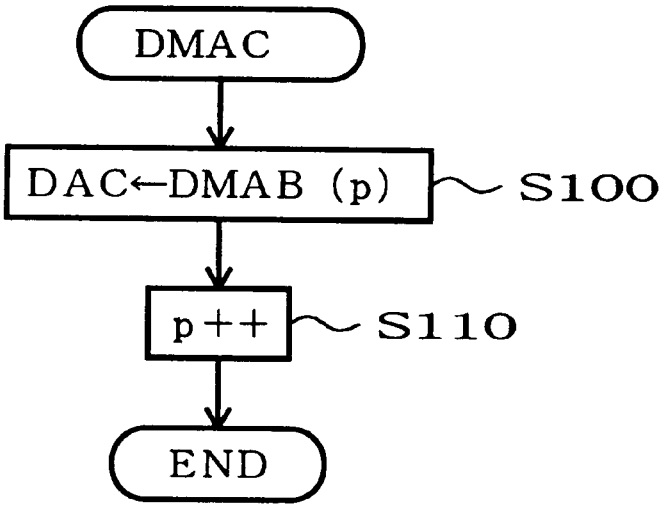
FIG. 6A is a flowchart illustrating operation of a DMAC.

FIG. 6A is a flowchart illustrating operation of the DMAC 10. When the empty space detecting section 113 in the CODEC 11 outputs DMA request signal DMAreq, the DMAC 10 goes to step S100, where it reads out the tone waveform sample data stored in the DMA 60 at an address pointed to by a current value p of the pointer register 101 and transfers the read-out sample data to the FIFO buffer 111. At next step S110, the DMAC 10 increments the value p of the pointer register 101 and then terminates the process corresponding to the DMA request signal DMAreq.

In this way, the tone waveform sample data is transferred from the DMAB 60 to the FIFO buffer 111 each time any empty space is detected in the buffer 11.

Figure 6B:
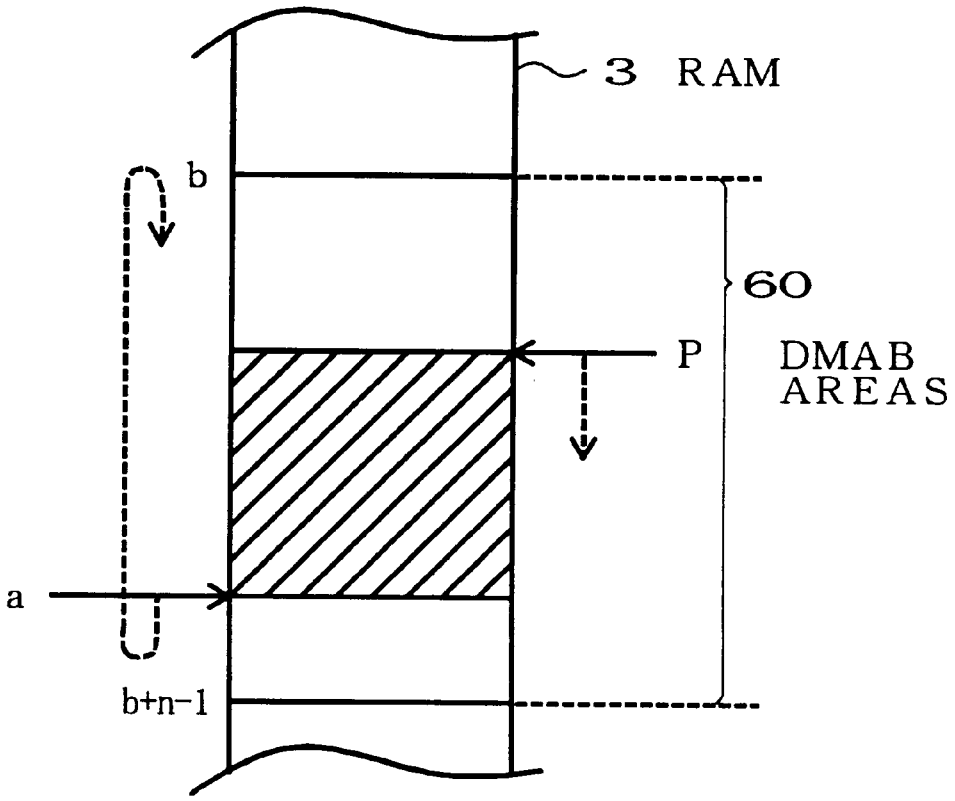
FIG. 6B is a diagram illustrating an example of a structure of a DMA buffer.

FIG. 6B is a diagram illustrating an example of a structure of the DMAB 60, in which a n-word block, ranging from start address "b" to end address "b+n−1", in the RAM 3 is used as the DMAB 60. The n-word block is divided into two areas for use as the first and second DMA buffer areas DMA1 and DMA2. In the illustrated example, the n-word block is divided into the hatched and non-hatched areas, so that when the DMAC 10 is reading out the tone waveform data from the hatched area (DMA1), the arithmetically formed tone waveform data can be written into the remaining n/2-word area (DMA2) starting with address "a". Once the write address "a" or read address "p" reaches the end address b+n−1 of the DMAB 60, it is returned to the start address "b".

Figure 7A:
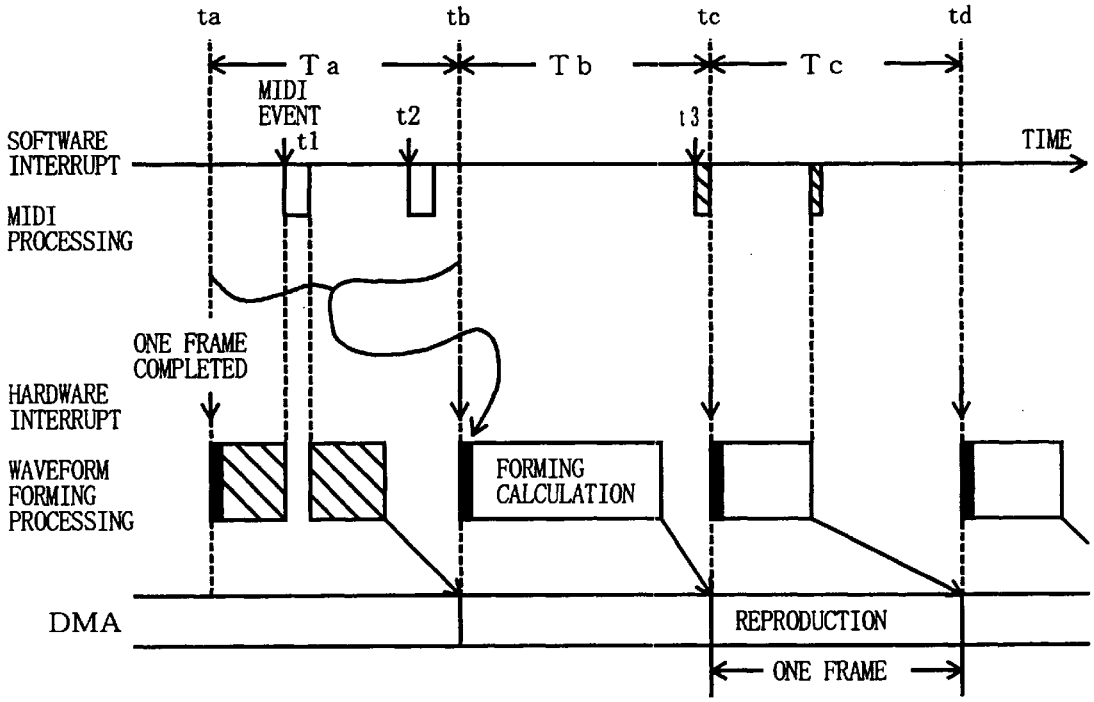
FIG. 7A is a chart explanatory of operational timing of MIDI processing and waveform forming processing.

FIG. 7A is a chart explanatory illustrating operational timing of the above-mentioned MIDI processing (step S10) and waveform forming processing (step S20), where the horizontal axis (abscissa) is a time axis. According to the present invention, the waveform forming calculation is executed frame by frame, as previously mentioned. In FIG. 7A, period Ta from time "ta" to "tb", period Tb from "tb" to "tc" and period Tc from time "tc" to "td" are all frames. Each downward-directed arrow in the top row of the figure indicates timing when a software interrupt signal is generated on the basis of a MIDI event produced from an application program such as the sequencer software; in the illustrated example, the software interrupt signal is generated at time points t1 and t2 within period Ta and at time point t3 within period Tb.

In a next row of FIG. 7A, there is shown timing when the MIDI processing (step S10) is executed; as shown, the MIDI processing is executed each time the MIDI-event-based software interrupt signal. Each downward-directed arrow in the intermediate row of the figure indicates timing when a hardware interrupt signal is generated by the above-mentioned CODEC 11. The hardware interrupt signals are generated at time points ta, tb, tc and td in synchronism with the cycle with which the waveform sample data are reproductively read out from the DMAB 60 by the DMAC 10 (i.e., in synchronism with the frame cycle), as indicated in the bottom row. Execution of the waveform forming processing (step S20) is initiated in response to each hardware interrupt signal. Tone waveform sample data arithmetically formed in this waveform forming processing are transferred to the above-mentioned DMA buffer (DMAB) upon completion of the waveform forming calculation. The beginning part, shown as painted in black in FIG. 7A, of each waveform forming calculation represents an interrupt-inhibiting period immediately after generation of the hardware interrupt signal.

The software interrupt based on MIDI event occurrence and the hardware interrupt from the CODEC 11 are given same level priority. Thus, when a software interrupt signal is generated during execution of the MIDI processing or waveform forming processing corresponding to a hardware interrupt signal, the execution of the processing is interrupted so as to execute the waveform forming processing or MIDI processing corresponding to the software interrupt signal. In the illustrated example, a software interrupt signal is generated at time point t1 during execution of the waveform forming processing corresponding to a hardware interrupt signal generated at time point ta, in response to which the waveform forming processing is interrupted to execute the MIDI processing corresponding to the MIDI event; then, upon completion of the MIDI processing, the remaining portion of the interrupted waveform forming processing is executed. Further, a hardware interrupt signal is generated at time point tc during execution of the MIDI processing corresponding to a software interrupt signal generated at time point t3, in response to which the MIDI processing is interrupted to execute the waveform forming processing; then, upon completion of the waveform forming processing, the interrupted MIDI processing is resumed.

Waveform forming calculation corresponding to the MIDI event received in period Ta is executed in period Tb, and then tone waveform sample data formed by the calculation are read out and audibly reproduced in period Tc. This means that each MIDI event is audibly reproduced two frames after the receipt of the MIDI event. Therefore, when a real-time performance is to be executed, it is desirable to make the length of each frame period short by reducing the size of the DMA buffer. According to the embodiment, the length of each frame period is chosen to correspond to 64 sample data. In contrast, when an automatic performance is to be executed, it is desirable to make the length of each frame period longer by increasing the size of the DMA buffer, in order to prevent unwanted break in a stream of generated tones.

The embodiment of the present invention is designed to execute the waveform forming calculation on the frame-by-frame basis as previously mentioned, the waveform forming calculation may sometimes fail to be completed within a predetermined frame. For example, when the waveform forming calculation is executed in parallel with other processing based, for example, on multi-media software requiring real-time computing capability, enough time can sometimes not be allocated to the software tone generator processing due to the fact that too much of the CPU's computing capability is spent on the other processing. According to the embodiment, the waveform formation is cancelled for such a frame where the calculation can not be completed in time. This allows the waveform calculation corresponding to a next frame in a stable manner, although there would be a temporary break in generated tones. This temporary break is very short (if the sampling frequency is 48 kHz and 64 sample data are formed in each frame, the frame period will only 1.3 msec.) and it's influence would be insubstantial.

Figure 7B:
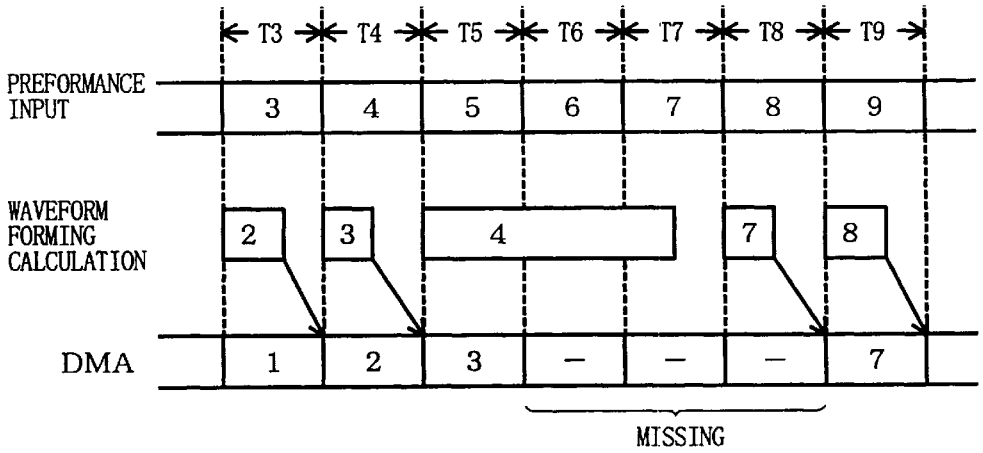
FIG. 7B illustrates by way of example how the waveform formation is cancelled.

FIG. 7B illustrates by way of example how the waveform formation is cancelled, in relation to a case where the waveform forming calculation corresponding to a MIDI performance input received in period T4 has been carried out from the beginning of period T5 to the middle of period T7 (although shown in the figure as being executed continuously, the waveform forming calculation, in practice, takes place intermittently because the CPU's control is directed to other processing as well). Thus, in the example of FIG. 7B, tone waveform sample data are cancelled which have been arithmetically formed from period T5 to period T7 in correspondence with the MIDI event received in period T4, so that there is no output from the DMA for corresponding periods T6, T7 and T8. Thus, no waveform forming calculation corresponding to the MIDI event received in period T5 and period T6 is executed, and it is in the waveform forming calculation corresponding to the MIDI event received in next period T7 when normal, stable waveform formation is resumed.

Figure 8A:
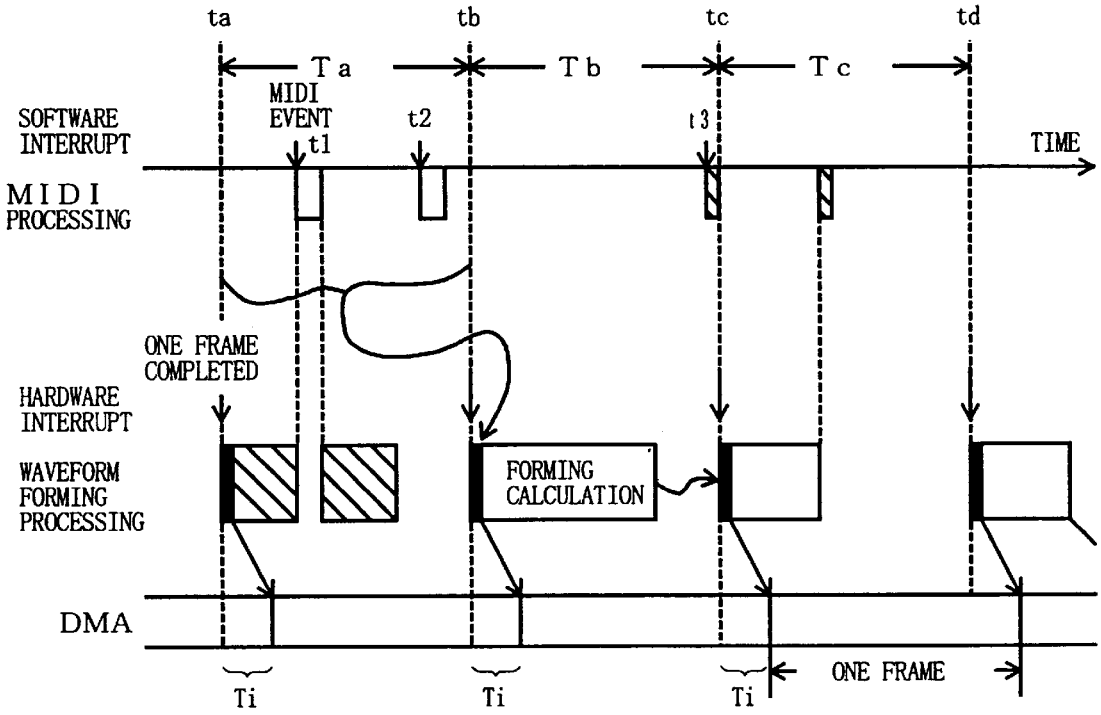
FIG. 8A is a diagram showing a modification of the present invention.

FIG. 8A shows a modification of the present invention. This modification is arranged in such a manner that each hardware interrupt signal is generated from the CEDEC 11 ahead of the reproduction end point for one frame by time Ti and that once timing to initiate current waveform forming calculation arrives, waveform sample data already formed by the previous waveform forming calculation are first transferred to the DMA buffer and then waveform sample data to be transferred in the next waveform forming calculation are formed by the current waveform forming calculation. This is because a time required for the waveform forming calculation does vary depending on the number of MIDI events; that is, by generating each hardware interrupt signal at earlier timing and transferring to the DMA buffer waveform sample data formed by the preceding waveform forming calculation at the start of the current calculation, the modification permits a stable data transfer to the DMA buffer. Advancing generation of the hardware interrupt signal by time Ti can be effected by the number-of-transferred-data detecting section 114 generating the interrupt signal when the counted number of transferred waveform sample data is smaller than that of FIG. 7A by a value corresponding to time Ti.

Figure 8B:
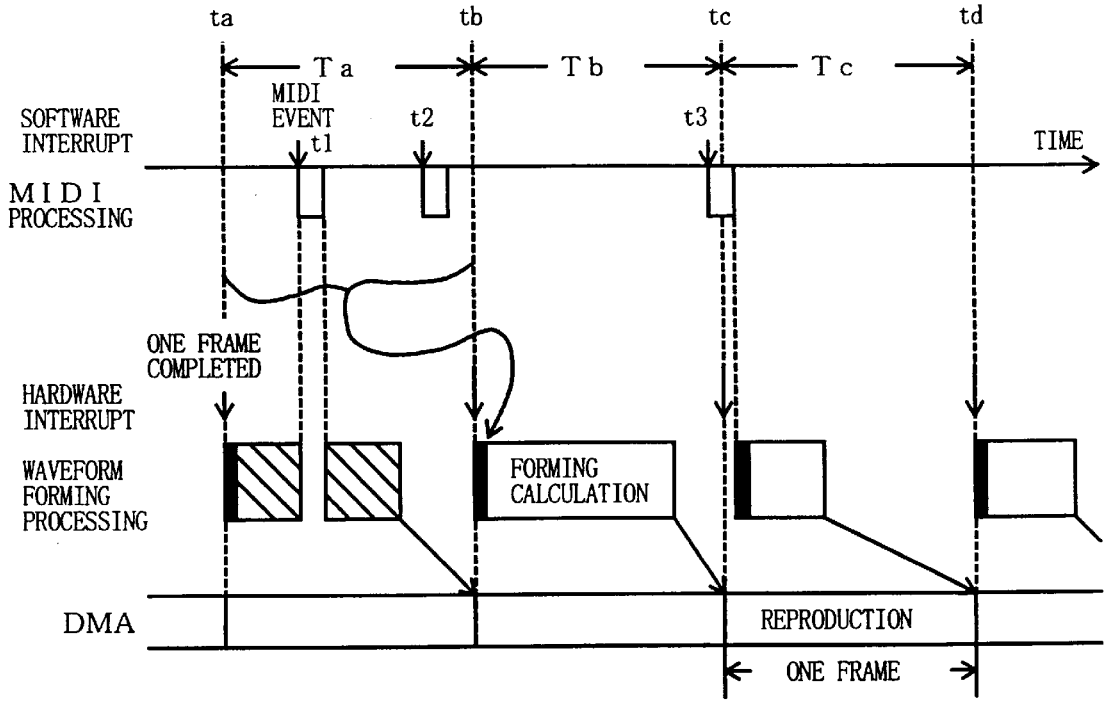
FIG. 8B is a diagram showing another modification of the present invention.

FIG. 8B shows another modification of the present invention, according to which software interrupt signals have priority over hardware interrupt signals. As shown, when a hardware interrupt signal is generated by the CODEC 11 at time point tc during the MIDI processing corresponding to a software interrupt signal generated at time point t3, the corresponding waveform forming calculation is executed after the MIDI processing.

While the number-of-transferred-data detecting section 114 in the CODEC 11 has been described above as detecting the number of transferred data to generate hardware interrupt signals, the CPU 1 or DMAC 10 may detect the number of transferred data to the D/A converter.

Further, while the described embodiments transfer waveform sample data to the FIFO buffer 111 and D/A converter 112 by means of the DMAC 10 in the sound input/output circuit (CODEC) 11, the waveform sample data may be transferred by means of the CPU 1 in a case where a high-speed bus is connected to a board having the CODEC 11 mounted thereon so that the data can be transferred to the CODEC 11 at high speed. In such a case, the CPU 1 transfers waveform sample data from the FIFO buffer 111 to the D/A converter, one sample per hardware interrupt signal generated every sampling cycle, and at the same time, the CPU 1 counts the number of the transferred samples. Then, every time the counted number shows that the transfer of the waveform sample data has been completed for one frame, a software interrupt signal is generated to initiate the waveform forming calculation.

Moreover, while the embodiments have been described as using Windows95 as the operating system, the tone generating method of the present invention may be implemented using any other operating system as such WindowsNT, MacOS or UNIX. The CPU used in the present invention may be other than x86 CPU, such as PowerPC (trademark of IBM Corporation) or other RISC processor.

Furthermore, the tone generating method of the present invention may be based on the FM, physical model or ADPCM technique rather than the above-mentioned waveform memory technique.

Various benefits are achieved by the present invention as follows:

Because the present invention arithmetically forms tone waveform sample data collectively on the frame-by-frame basis (for each frame), it can effectively enhance the calculating efficiency and quality of tones to be generated and also increase the number of tone generating channels capable of simultaneously generating tones.

Because the virtual device drivers are placed at a level closer to hardware, time delays in generating interrupt signals are substantially reduced. In addition, the virtual device drivers are run with 32-bit codes, the MIDI processing and waveform forming processing can be executed at high speeds, the waveform forming calculation can be performed in a stable manner. Besides, the software tone generator of the present invention can be shared among a plurality of virtual machines.

Moreover, the virtual machines can use the same device drivers as where a hardware tone generator is used, and there can be provided a software tone generator compatible with the hardware tone generator.

Furthermore, the DMA buffer can be set to any desired small size, so that time delays in generating tones for a real-time performance can be minimized. In addition, because the present invention is arranged to cancel waveform formation for every frame where the waveform forming calculation can not be completed in time, stable operating can be readily resumed even when the tone generating operation is disturbed for some reason.

What is claimed is:

1. A tone generating device for generating a tone waveform by executing predetermined software via a processing unit, said processing unit including a processor for executing the predetermined software, a buffer memory, a digital-to-analog converter and a counter, said processing unit generating the tone waveform by, on the basis of the predetermined software, performing:

a first step of, upon reception of performance information, generating tone-generation control information corresponding to the performance information;

a second step of generating a plurality of waveform samples on the basis of the tone-generation control information and storing the generated waveform samples into said buffer memory;

a third step of sending one of the waveform samples stored in said buffer memory to said digital-to-analog converter, every sampling cycle;

a fourth step of, via said counter, counting a number of the waveform samples sent to said digital-to-analog converter, every sampling cycle; and a fifth step of generating a start signal for activating said second step each time it is detected on the basis of a counted value of said counter that a predetermined number of the waveform samples have been sent to said digital-to-analog converter.

2. A tone generating device for generating a tone waveform by executing predetermined software via a processing unit, said processing unit including a processor for executing the predetermined software, a buffer memory capable of storing therein a first predetermined number of waveform samples, a digital-to-analog converter, and a first-in first-out memory capable of storing therein a second predetermined number of waveform samples less than said first predetermined number of waveform samples and sending one of the waveform samples stored therein to said digital-to-analog converter, said processing unit generating the tone waveform by, on the basis of the predetermined software, performing:

a first step of, upon reception of performance information, generating tone-generation control information corresponding to the performance information;

a second step activated, in response to detection of a decrease in a number of the waveform samples stored in said buffer, for generating a plurality of waveform samples on the basis of the tone-generation control information and storing the generated waveform samples into said buffer memory; and a third step of sequentially sending the waveform samples stored in said buffer memory to said first-in first-out memory, each time a vacancy occurs in said first-in first-out memory.

3. A tone generating device for generating a tone waveform by executing predetermined software via a processing unit, said processing unit including a processor for executing the predetermined software, a buffer memory capable of storing therein a first predetermined number of waveform samples, a digital-to-analog converter, a first-in first-out memory capable of storing therein a second predetermined number of waveform samples less than said first predetermined number of waveform samples and sending one of the waveform samples stored therein to said digital-to-analog converter, and a counter for generating a start signal each time the waveform samples sent by said first-in first-out memory to said digital-to-analog converter reaches a predetermined number, said processing unit generating the tone waveform by, on the basis of the predetermined software, performing:

a first step of, upon reception of performance information, generating tone-generation control information corresponding to the performance information;

a second step activated, in response to said start signal, for generating a plurality of waveform samples on the basis of the tone-generation control information and storing the generated waveform samples into said buffer memory; and a third step of sequentially sending the waveform samples stored in said buffer memory to said first-in first-out memory, each time a vacancy occurs in said first-in first-out memory.

* * * * *